United States Patent [19]

Gorille

[11] 4,248,195

[45] Feb. 3, 1981

[54] APPARATUS FOR CONTROLLING THE DUTY FACTOR OF SEQUENCE OF CYCLICALLY OCCURRING PULSES CONTROLLING FLOW THROUGH AN IMPEDANCE

[75] Inventor: Ingo Gorille, Oberriexingen, Fed. Rep. of Germany

[73] Assignee: Robert Bosch GmbH, Stuttgart, Fed. Rep. of Germany

[21] Appl. No.: 4,670

[22] Filed: Jan. 19, 1979

[30] Foreign Application Priority Data

Jan. 27, 1978 [DE] Fed. Rep. of Germany ..... 2803556

[51] Int. Cl.[3] ..... F02P 3/00

[52] U.S. Cl. ..... 123/416; 123/609; 315/209 T

[58] Field of Search ..... 123/117 D, 117 R, 148 E; 307/362; 328/146; 315/209 T

[56] References Cited

U.S. PATENT DOCUMENTS

| | | | |
|---|---|---|---|
| 3,605,713 | 9/1971 | Masters et al. | 123/148 E |
| 3,831,571 | 8/1974 | Weber | 123/148 E |
| 4,018,202 | 4/1977 | Gartner | 123/148 E |
| 4,019,484 | 4/1977 | Mori | 123/148 E |
| 4,043,302 | 8/1977 | Sessions | 123/148 E |
| 4,083,347 | 4/1978 | Grather et al. | 123/148 E |
| 4,088,107 | 5/1978 | Chateau | 315/209 T |

*Primary Examiner*—P. S. Lall

*Attorney, Agent, or Firm*—Frishauf, Holtz, Goodman & Woodward

[57] ABSTRACT

The duty factor of pulses controlling the time throughout which current flows through an ignition coil is increased or decreased depending upon whether the current through the ignition coil at the last ignition time was less than or greater than the desired amplitude required for ignition. A sample—and—hold circuit samples the output of a comparator comparing the actual current to the desired current at ignition time. If the comparator indicates that the actual current amplitude was less than the desired current amplitude, a first counter is set to count downwards. It counts down by one unit and then its count is transferred to another counter. When the count on the other counter reaches a predetermined count, the current through the ignition coil is initiated. The current is interrupted when either the next ignition timing signal or a signal signifying that the actual current through the ignition coil has reached the desired value is received, whichever is later. In an alternate embodiment, the current is terminated in response to the ignition timing signal, regardless of the then-present value of ignition current.

10 Claims, 3 Drawing Figures

APPARATUS FOR CONTROLLING THE DUTY FACTOR OF SEQUENCE OF CYCLICALLY OCCURRING PULSES CONTROLLING FLOW THROUGH AN IMPEDANCE

Cross reference to related applications and publications:

DT-OS No. 2,504,843;≐U.S. Pat. No. 4,063,539

DT-OS No. 2,523,388;≐U.S. Application Ser. No. 669,814 (Mar. 24, 1976)=U.S. Pat. No. 4,099,507

The present invention relates to apparatus for controlling the duty factor in a sequence of cyclically occurring pulses controlling current flow through an impedance element. Specifically, it relates to apparatus for controlling the pulse width of pulses applied to the ignition circuit of an internal combustion engine wherein the duration of current flow through the ignition coil is substantially equal to said pulse width. The amplitude of current flowing through said ignition coil at the ignition time should have a desired amplitude sufficient to cause adequate ignition energy to be stored in said ignition coil.

BACKGROUND AND PRIOR ART

Apparatus of the type set forth above is disclosed in U.S. Pat. No. 4,099,507. In this German publication, as in the present invention, a sequence of auxiliary pulses is furnished by a sensor sensing, for example, markings on a rotating shaft of an internal combustion engine. As in the present invention, a counter is provided for counting these auxiliary pulses and a decoding stage furnishes a signal when the count on the counter has reached a predetermined count. However, in the system disclosed in DT-OS No. 2,523,388, the duty factor (ratio of pulse width to period of the control pulse sequence) is not changed as a function of current build-up time through the impedance element but is determined by the output of a timing circuit. For internal combustion engines in particular this arrangement has the disadvantage that changes in supply voltage cause changes in the energy stored in the ignition coil and therefore result in ignition pulses having variable energies. A further disadvantage is that the pulse width of the control pulses of the known apparatus must be so designed that sufficient ignition energy will be available even when the supply voltage is particularly low. When the supply voltage is higher, the ignition current will then be greater than required, leading to excessive current flow through the primary winding of the ignition coil. This in turn causes high power losses and possibly destruction of the circuit elements in the primary circuit. In addition, the circuit elements in the primary circuit of the ignition coil must be manufactured to very small tolerances so that the current build-up time specified by the timing circuit results in sufficient energy stored in the ignition coil. It is also very difficult to compensate the temperature variations in the known apparatus.

THE INVENTION

In the system of the present invention, adjusting means are provided which adjust the timing of the furnishing of a current initiate signal defining the leading edge of the control pulse in dependence on the relationship between the actual amplitude and the desired amplitude of the current through the impedance element at the time of receipt of a last previous timing signal furnished, for example, by a stage computing the desired ignition time. The pulse width, and therefore the time of current flow through the impedance element is increased if the actual current amplitude at the time the timing signal is furnished is less than the desired current amplitude and is increased when the opposite is true.

The system of the present invention, when incorporated in an ignition system of an internal combustion engine controls the time of current flow through the ignition coil so that, at the end of the time, the current amplitude will be sufficient for sufficient energy to be stored in the ignition coil, independent of variations in supply voltage and other variations in operating conditions such as the temperature. Losses are minimized, as is the thermal load in the primary ignition circuit. Circuits for regulating the amplitude of the current flowing through the primary winding of the ignition coil may be dispensed with.

DRAWINGS ILLUSTRATING PREFERRED EMBODIMENTS

Figure 1:
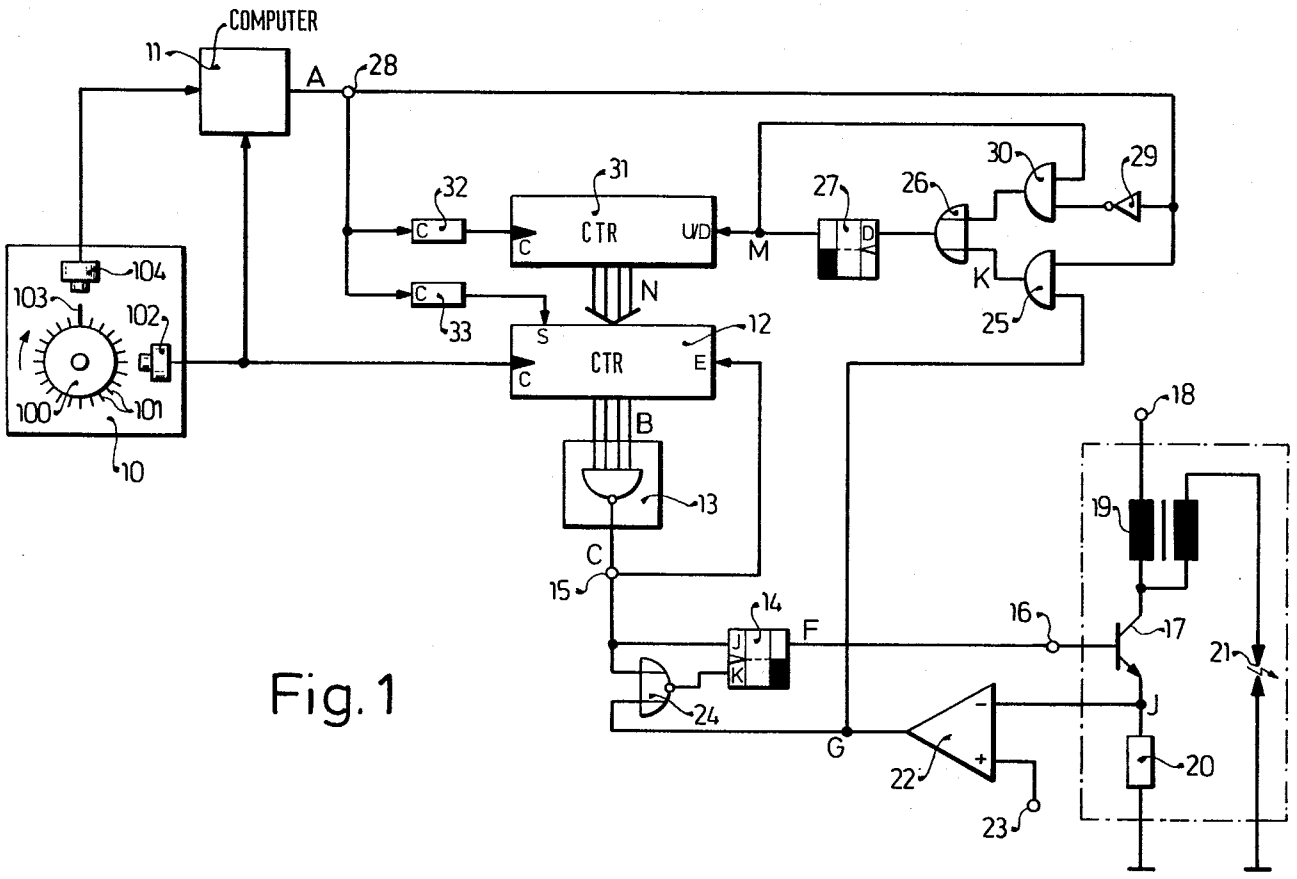
FIG. 1 is a schematic diagram showing a first embodiment of the present invention.
Figure 3:
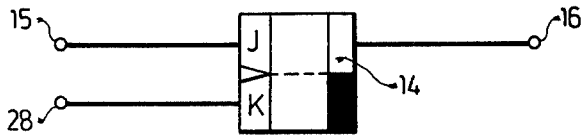

and FIG. 3 shows a circuit element of FIG. 1 connected to constitute a second embodiment of the present invention.

In FIG. 1, a sensing and signal generating unit 10 may, for example, comprise a toothed disk 100 mounted on a shaft of an internal combustion engine. Teeth 101 are arranged around the periphery of disk 100 at equal angular intervals. When teeth 101 pass a sensor and signal generator 102, the latter furnishes a sequence of auxiliary pulses. In a preferred embodiment, the teeth are ferromagnetic teeth and sensor 102 is an inductive sensor whose inductivity changes when a tooth passes. The change in inductivity results in the generation of one of the above-mentioned auxiliary pulses. Of course other sensors and sensed elements may be provided. For example disk 101 may be magnetized along strips on its circumference or may have perforations which are sensed by optical sensors. Disk 100 also carries a reference mark 103 or a plurality of such marks depending upon the application. For example, if the present invention is utilized in an internal combustion engine, the number of such marks will correspond to the number of ignitions to be initiated per rotation of disk 100, that is it will be proportional to the number of cylinders. Many alternate embodiments are possible. For example the reference mark which, when sensed by a sensor 104 will result in the furnishing of a reference pulse by the sensor might be mounted on a different disk or a plurality of such reference pulses may be generated in response to each sensed reference mark. For example for a six-cylinder internal combustion engine three reference marks, separated from each other by 120° of angular rotation, will be required. Pulse shaper stages may be provided at the output of sensors 102 and 104 in order that the generated pulses will be of substantially rectangular shape. These pulse shaper stages are not shown.

Sensors 102 and 104 are each connected to an ignition time computing stage 11. Computing stage 11 furnishes a sequence of timing signals (timing pulses denoted by A in FIG. 1) at a terminal 28. The computing stage may have other inputs for receiving signals signifying the then-present value of various parameters such as, for example, operating temperature, pressure in the intake manifold, throttle valve position, etc. The timing signal is generated at a time in the cycle of the engine at which ignition is desired. The current through the ignition coil is thus to be interrupted at this time. Generation of timing signal A in stage 11 is not part of the present invention. One embodiment of a stage for generating the desired ignition time in an internal combustion engine on the basis of ignition angle chracteristic curves is disclosed in U.S. Pat. No. 4,063,539.

The output of sensor 102 is connected to the counting input C of a digital counter 12. The counting outputs of counter 12 are connected to the inputs of a decoder 13 which furnishes an output signal when the count on counter 12 is a predetermined counting output number. The output of decoder 13 is connected to a blocking input E of counter 12 and to the J input of a JK flip-flop 14. As shown in FIG. 1, decoder 13 is an AND gate which receives signals either directly or in inverted form from counter 12 depending upon the particular count constituting the predetermined counting number. A terminal 15 is connected to the output of decoder 13.

The output of flip-flop 14 is connected to a terminal 16 which in turn is connected to the base of a transistor 17. Any known type of semiconductor switching element such as, for example, a thyristor may be substituted for transistor 17. The collector of transistor 17 is connected to a terminal 18 connected to the positive side of the voltage supply through the primary winding 19 of an ignition coil. The emitter of transistor 17 is connected to a terminal J and, through a resistor 20, to a reference potential such as chassis or ground potential. Spark producing means 21 are connected to the secondary winding of the ignition coil and to the same reference potential. Spark producing means in an internal combustion engine are generally spark plugs. For a plurality of spark plugs, a known high voltage distributor would be provided.

Terminal J is connected to the inverting input of a comparator 22, while a reference input signifying the desired current amplitude is applied at a terminal 23 connected to the direct input of comparator 22. The output of comparator 22 is connected through a NOR gate 24 to the K input of flip-flop 14. The second input of NOR gate 24 is connected to terminal 15. Further, the output of comparator 22 is connected through an AND gate 25 to the input of an OR gate 26. The output of OR gate 26 is connected to the D input of a D flip-flop 27. Terminal 28 is connected directly to the second input of AND gate 25 and, through an inverter 29, to one input of an AND gate 30. The output of AND gate 30 is connected with the second input of OR gate 26. The output of flip-flop 27 is connected to the second input of AND gate 30 and is further connected to the up/down control input of a counter 31. The counting outputs of counter 31 are connected to preset inputs of counter 12. Terminal 28 is connected through a first delay element 32 to the counting input of counter 31 and to a preset control input of counter 12 through a delay element 33. Delay elements 32 and 33 may be digital delay elements such as a single flip-flop or a plurality of flip-flops connected in cascade.

OPERATION

Figure 2:
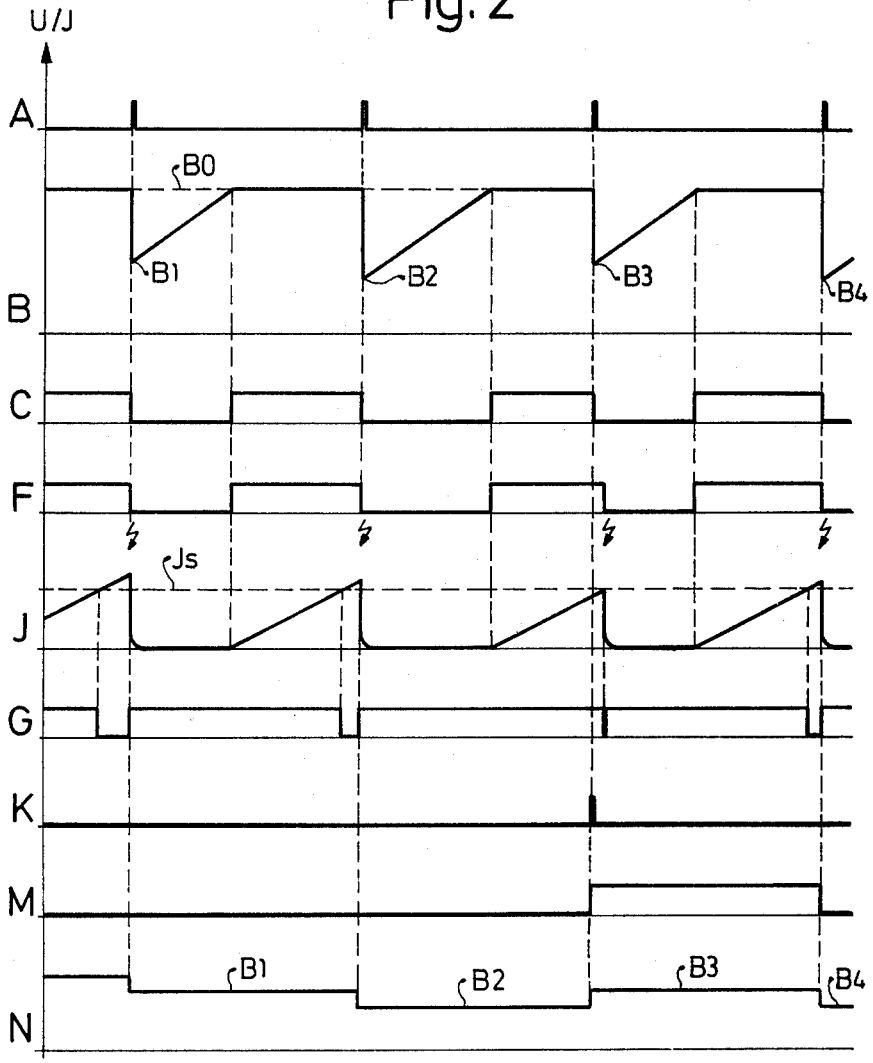
FIG. 2 is a timing diagram showing variations of signal amplitude at various points in the circuit of FIG. 1.

The operation of the above-described system will now be explained with reference also to FIG. 2. In FIG. 2, a high level indicates a "1" signal while a low level indicates a "0" signal. The "1" signal and the "0" signal each have a corresponding voltage level associated therewith. A specific voltage level in the preferred embodiment is a voltage approximately equal to the supply voltage for the "1" signal and a voltage equal to the reference or ground voltage for the "0" signal.

Returning now to FIG. 1, a timing signal A appears at a time calculated by computing stage 11 during each cycle of the cyclically operating signal. As mentioned before, the timing signal in a preferred embodiment is the signal signifying the desired ignition time or time for interrupting of current through the ignition coil. The time throughout which current flows prior to the ignition time, that is the time during which switch 17 is conductive, is determined by counts on counter 12. Specifically, signal A resets counter 12. Resetting of counter 12 causes the signal at the output of decoder 13 to change from a "1" signal to a "0" signal. At the time of occurrence of signal A the output of comparator 22 is sampled. Specifically, AND gate 25 will furnish a "1" signal if the output of comparator 22 is high at the time signal A is applied to its second input. The output of comparator 22 is a "1" signal when the amplitude of current flowing through resistor 20 and therefore through primary winding 19 of the ignition coil is less than the desired amplitude and is a "0" signal when the actual amplitude is greater than the desired amplitude. If a "1" signal exists at the output of comparator 22, the actual time that current has flown through the primary winding of the ignition coil is too short. If the opposite is true, it may have been too long. The signal M at the output of the sample—and—hold circuit thus contains the information as to whether the computed closure time of switch 17 was too long or too short. Depending upon the value of signal M, counter 31 counts up or down. Since the signal at the output of counter 31 is the signal used to preset counter 12, the count on counter 31 directly affects the closure time of switch 17. If the frequency or repetition rate of the timing signal A remains the same, that is if, for example, the engine speed remains the same, the count on counter 31 is alternately increased or decreased by one unit which causes a corresponding oscillation by a very small amount about the computed time at which closure of switch 17 is to occur. If the engine speed changes or if the time required for the current through resistor 20 to reach a predetermined value changes for example because of temperature changes or changes in supply voltage, then the value generated in counter 31 is automatically corrected in accordance with such change; that is, the time that switch 17 closes permitting current to flow through resistor 20 is advanced or retarded correspondingly.

In the first cycle shown in FIG. 2 the current I reaches its desired amplitude $I_s$ before the computed or desired curcurrent interrupt time, namely the time at which signal A is furnished. When the amplitude of the current reaches the desired amplitude, that is when line I intersects line $I_s$, the signal G at the output of comparator 22 changes from a "1" to a "0" level. When the signal A appears, three things occur. First, since G is a "0" signal when signal A arrives, the output of AND gate 25 will be a "0" signal. Flip-flop 27 therefore retains its state, that is the signal M remains a "0" signal. Counter 31 counts down. The signal at the output of delay unit 32, namely the signal A delayed by one clock pulse, causes counter 31 to count down one unit. This results in the count B1 shown in line N of FIG. 2. Delay unit 33 delays signal A by two clock pulses. When signal A is applied to the S input of counter 12, counter 12 is preset to the number then present on counter 31. Since the clock signals for the flip-flops are generally of a frequency of approximately 50 kHz, the double delay in unit 33 is sufficiently small in actual time that it has only a negligible effect on the current interrupt time (ignition time). The presetting of counter 12 which, for the given example is a downward change, causes signal C to change from a "1" level to a "0" level. If, as is the case in this example, the signal G is already a "0" signal, the change in signal C from a "1" signal to a "0" signal causes a signal to be applied to the K input of flip-flop 14. Flip-flop 14 resets, removing the positive voltage from the base of transistor 17 and thereby interrupting current flow through ignition coil 19.

Counter 12 now starts the count upwards with a frequency determined by the repetition rate of the auxiliary pulses. Since the number B1 from which it now counts is lower than the number from which it counted previously, the value determined by decoder 13 will be reached at a later time than it was in the previous cycle. When the count on counter 12 reaches the value B0 defined by the inputs of AND gate 13, the signal at terminal 15 changes from a "0" signal to a "1" signal. the "1" signal at terminal 15 blocks counter 12 and also sets flip-flop 14. Current starts to flow through ignition coil 19. However, even in the second cycle the amplitude of the current reaches the desired value $I_s$ before receipt of the next-following signal A. The count to which counter 12 is preset is therefore again lowered by one unit.

In the third cycle, the amplitude of current through the ignition coil has not yet reached the desired value $I_s$ when signal A is received. A "1" signal therefore still appears at the output of comparator 22 when signal A is received by AND gate 25. Signal K at the output of AND gate 25 changes to a "1" signal causing the output of flip-flop 27 to change from a "0" signal to a "1" signal. The counting direction in counter 31 is reversed and the count B2 is increased to a count B3 one unit higher when delayed signal A appears at the counting input of counter 31. Since NOR gate 24 only furnishes an output signal when signals at all of its inputs are "0" signals, flip-flop 14 will not be reset until the signal at the output of comparator 22 changes to a "0" signal. The ignition time is, in other words, delayed until such time as the current through coil 19 has reached the desired amplitude. In the fourth cycle shown in FIG. 2 the same conditions are present as were present in the second cycle, that is signal K is a "0" signal, signal M is a "0" signal and the count on counter 31 is decreased by one unit when signal A is applied to its counting input. If the repetition rate of signal A now remains constant and neither the voltage nor the temperature nor any circuit components in the primary circuit of the ignition coil undergo any changes, then the count on counter 31 will alternately be increased and decreased by one unit.

Of course the change in the count on counter 31 at each ignition time could be by an amount larger than one. This would cause greater oscillations during static conditions but would result in a more rapid response in dynamic operation, e.g. in response to strong accelerations. An embodiment utilizing counting changes of more than one could be realized by including a frequency multiplier stage at the output of delay unit 32.

The connection shown for flip-flop 14 in FIG. 3 results in a second embodiment of the present invention. The remainder of the circuit would be the same as that in FIG. 1 The only difference is that in FIG. 3 the K input of flip-flop 14 is directly connected to terminal 28. Flip-flop 14 will thus reset directly in response to each signal A. While in the embodiment shown in FIG. 1 the current flowing through coil 19 must have reached the desired amplitude before ignition can occur, even if the actual ignition time is delayed relative to the desired ignition time, the second embodiment will cause the spark to be generated at the desired ignition time regardless of whether or not the current amplitude has reached the desired value. In other words in order to cause ignition to take place precisely at the correct moment, variations in the energy available at ignition time are tolerated. Which embodiment should be used depends upon the particular application.

To summarize: for both embodiments the signal at terminal G determines whether the count on counter 31 is increased or decreased, that is whether the start of signal F will be advanced or delayed in turn increasing of decreasing the duty factor of signal F. The trailing edge of pulse F and therefore the ignition time will take place at the desired ignition time or at the time the amplitude of current through coil 19 has reached the desired amplitude, whichever is later. In the second embodiment the ignition time will be the time at which signal A is received, regardless of whether or not the current through coil 19 has reached the desired amplitude.

Various changes and modifications may be made within the scope of the inventive concepts.

I claim:

1. In a cyclically operable system having first circuit means having an impedance element (19) and control means (17, 14) connected to said impedance element for interrupting current flow therethrough in response to a current interrupt signal, and means for furnishing a timing signal (A) at a desired current interrupt time in each cycle, apparatus for furnishing said current interrupt signal, comprising means for continuously comparing the actual amplitude of said current to a desired amplitude and furnishing a comparator output signal only when said actual amplitude is greater than said desired amplitude; and logic circuit means (24, 14) connected to said timing signal furnishing means, said comparator means and said control means for delaying said timing signal until receipt of said comparator output signal and furnishing said current interrupt signal in response to the so-delayed timing signal.

2. In a cyclically operable system having first circuit means having an impedance element (19) and control means (17, 14) connected to said impedance element for initiating and interrupting current flow therethrough in response to a current initiate and a current interrupt signal respectively, whereby current flows through said impedance element for a current flow time substantially equal to the difference in time between receipt of said current initiate signal and said current interrupt signal by said control means, said system further having means for furnishing a timing signal (A) at a desired current interrupt time in each cycle thereof, and adjustable timing means (31, 12, 13) connected to said means for furnishing a timing signal for furnishing one of said current initiate signals an adjustable time interval following each of said timing signals, whereby said current flow decreases and increases, respectively, with increases and decreases of said adjustable time interval, the actual amplitude of said current at the end of said flow time differing from a desired amplitude in dependence on then-present operating conditions, the improvement comprising adjusting means (22, 25–30) connected to said first circuit means, said timing signal furnishing means and said adjustable timing means for, respectively, increasing and decreasing said adjustable time interval when said actual amplitude of said current is, respectively, greater or less than said desired amplitude when said timing signal furnishing means furnishes said timing signal.

3. A system as set forth in claim 2, wherein said adjusting means comprises comparator means (22) for comparing said actual amplitude to said desired amplitude and furnishing a first comparator output signal when said actual amplitude is less than said desired amplitude and a second comparator output signal when said actual amplitude is greater than said desired amplitude, and sample—and—hold means connected to said comparator means for sampling said comparator output signal at receipt of said timing signal and adjusting said adjustable timing means to decrease and increase said adjustable time interval in response to said first and second comparator signal, respectively.

4. In a cyclically operable system having first circuit means having an impedance element (19), control means (17, 14) connected to said impedance element for initiating and interrupting current flow therethrough in response to a current initiate and a current interrupt signal respectively, said control means comprising switch means connected in series with said impedance element and having a conductive and a blocked state in the presence and absence, respectively, of a control pulse applied thereto, means for furnishing a timing signal (A) at a desired current interrupt time in each cycle thereof, and adjustable timing means (31, 12, 13) connected to said timing signal furnishing means for furnishing one of said current initiate signals an adjustable time interval following each of said timing signals, the improvement comprising adjusting means (22, 25–30) connected to said first circuit means, said timing signal furnishing means and said adjustable timing means for, respectively, increasing and decreasing said adjustable time interval when the actual amplitude of said current is, respectively, greater or less than a desired amplitude when said timing signal furnishing means furnishes said timing signal, said adjusting means comprising bistable circuit means (14) having a first and second input and an output for furnishing said control pulse in response to a signal applied at said first input and blocking said control pulse in response to a signal applied at said second input, and means connecting said current initiate signal to said first input and said timing signal to said second input of said bistable circuit means, whereby said timing signal constitutes said current interrupt signal.

5. A system as set forth in claim 4, wherein said adjusting means further comprises comparator means connected to said first circuit means for furnishing a first and second comparator output signal when said actual amplitude of said current flowing through said impedance element is, respectively, less than and greater than said desired amplitude, and logic circuit means (24) having a first input connected to said comparator means and a second input connected to receive said timing signal for furnishing a signal to said second input of said bistable circuit means in response to the last-received one of said timing signal and said second comparator output signal, whereby said current through said impedance element is interrupted at said desired current interrupt time only if said actual amplitude of said current exceeds said desired amplitude.

6. In a cyclically operable system having first circuit means having an impedance element (19), control means (17, 14) connected to said impedance element for initiating and interrupting current flow therethrough in response to a current initiate and a current interrupt signal respectively, means for furnishing a timing signal (A) at a desired current interrupt time in each cycle thereof, and adjustable timing means (31, 12, 13) connected to said timing signal furnishing means for furnishig one of said current initiate signals an adjustable time interval following each of said timing signals, the improvement comprising adjusting means (22, 25–30) connected to said first circuit means, said timing signal furnishing means and said adjustable timing means for, respectively, increasing and decreasing said adjustable time interval when the actual amplitude of said current is, respectively, greater or less than a desired amplitude when said timing signal furnishing means furnishes said timing signal, said adjusting means comprising comparator means (22) for comparing said actual amplitude to said desired amplitude and furnishing a first comparator output signal when said actual amplitude is less than said desired amplitude and a second comparator output signal when said actual amplitude is greater than said desired amplitude, and sample—and—hold means connected to said comparator means for sampling said comparator output signal at receipt of said timing signal and adjusting said adjustable timing means to decrease and increase said adjustable time interval in response to said first and second comparator signal, respectively, and first delay means (32) connected between said timing signal furnishing means and said counting input for delaying each of said timing signals by first predetermined time interval prior to application to said counting input; and wherein said adjustable timing means comprises up/-down counting means (31) having a counting input connected to said timing signal furnishing means, an up/down control input connected to said sample—and—hold means and a counting output for storing a first number and for adding or subtracting a predetermined number to said first number in response to said timing signal in the presence of absence of said first adjustment signal, respectively, thereby creating a preset number and for furnishing said preset number at said counting output.

7. A system as set forth in claim 6, wherein said sample—and—hold means comprises first AND gate means (25) having a first and second input connected to receive said comparator output signal and said timing signal, respectively and an AND gate output for furnishing an AND gate output signal only in the joint presence of said timing signal and said first comparator output signal, and bistable circuit means (27) having an input connected to said first AND gate means and an output connected to said adjustable timing means for furnishing a first adjustment signal decreasing said adjustable time interval in response to said AND gate output signal.

8. A system as set forth in claim 7, wherein said sample—and—hold means further comprises inverter means (29) connected to said timing signal furnishing means for furnishing an inverter timing signal, second AND gate means (30) having a first input connected to said inverter means, a second input connected to said output of said bistable circuit means and an AND gate output, and OR gate means (26) having a first input connected to said output of said first AND gate means, a second input connected to said output of said second AND gate means and an output connected to said bistable circuit means.

9. A system as set forth in claim 6, further comprising means (102) for furnishing a plurality of auxiliary pulses during each of said cycles of said cyclically operable system;

and wherein said adjustable timing means further comprises second counting means (12) having a counting input connected to said means for furnishing said plurality of auxiliary pulses, a set control input, a preset input connected to said output of said up/down counting means, a blocking input and a counting output for counting said auxiliary pulses starting at said preset number and furnishing a counting output number corresponding to the number of so-counted auxiliary pulses, and means (13) connected to said counting output of said second counting means for furnishing said current initiate signal when said counting output number is a predetermined counting output number.

10. A system as set forth in claim 9, wherein said second counting means has a plurality of counting outputs, the signals at said counting outputs constituting said counting output number;

and wherein sid means for furnishing said current initiate signal comprises AND gate means (13) connected to said counting outputs for furnishing said current initiate signal and a blocking signal to said blocking input of said second counting means in response to counting output signals signifying said counting output number.

* * * * *